United States Patent [19]

Aanensen

[11] 4,157,742

[45] Jun. 12, 1979

[54] ACCOMMODATION LADDER ARRANGEMENTS

[75] Inventor: Oscar Aanensen, Torvastad, Norway

[73] Assignee: Marine Aluminum Aanensen & Co. A/S, Haugesund, Norway

[21] Appl. No.: 923,334

[22] Filed: Jul. 10, 1978

[30] Foreign Application Priority Data

Jul. 18, 1977 [NO] Norway ..... 772541

[51] Int. Cl.[2] ..... E06C 9/06; B63B 29/20

[52] U.S. Cl. ..... 182/97; 182/1; 182/104; 182/116; 182/207; 14/71.1

[58] Field of Search ..... 182/1, 97, 2, 65, 66, 182/64, 116, 115, 207, 104; 14/71.1, 71.3, 71.5

[56] References Cited

U.S. PATENT DOCUMENTS

| | | | |
|---|---|---|---|
| 3,008,158 | 11/1961 | Stinson | 14/71.1 |
| 3,163,873 | 1/1965 | Hopkins | 14/71.1 |
| 3,451,504 | 6/1969 | Logan | 182/1 |
| 3,800,912 | 4/1974 | Ashworth | 182/2 |
| 3,875,603 | 4/1975 | Mampaey | 14/71.3 |

*Primary Examiner*—Reinaldo P. Machado
*Attorney, Agent, or Firm*—McCormick, Paulding & Huber

[57] ABSTRACT

Accommodation ladder having a first flight of steps of adjustable length with one end adapted for connection to a ship while its opposite end is pivotably mounted about a horizontal axis at a given level above the quayside. This flight of steps is also mounted for pivotal movement about a vertical axis passing between its opposite ends at a location substantially spaced from its horizontal pivotal axis. A second flight of steps is adapted for mounting at one end adjacent the quayside to pivot about the vertical axis and extends upwardly from this mounting to interconnect with the first flight of steps enabling joint pivoting with the latter about this axis.

3 Claims, 2 Drawing Figures

—FIG.1—

ACCOMMODATION LADDER ARRANGEMENTS

Figure 1:
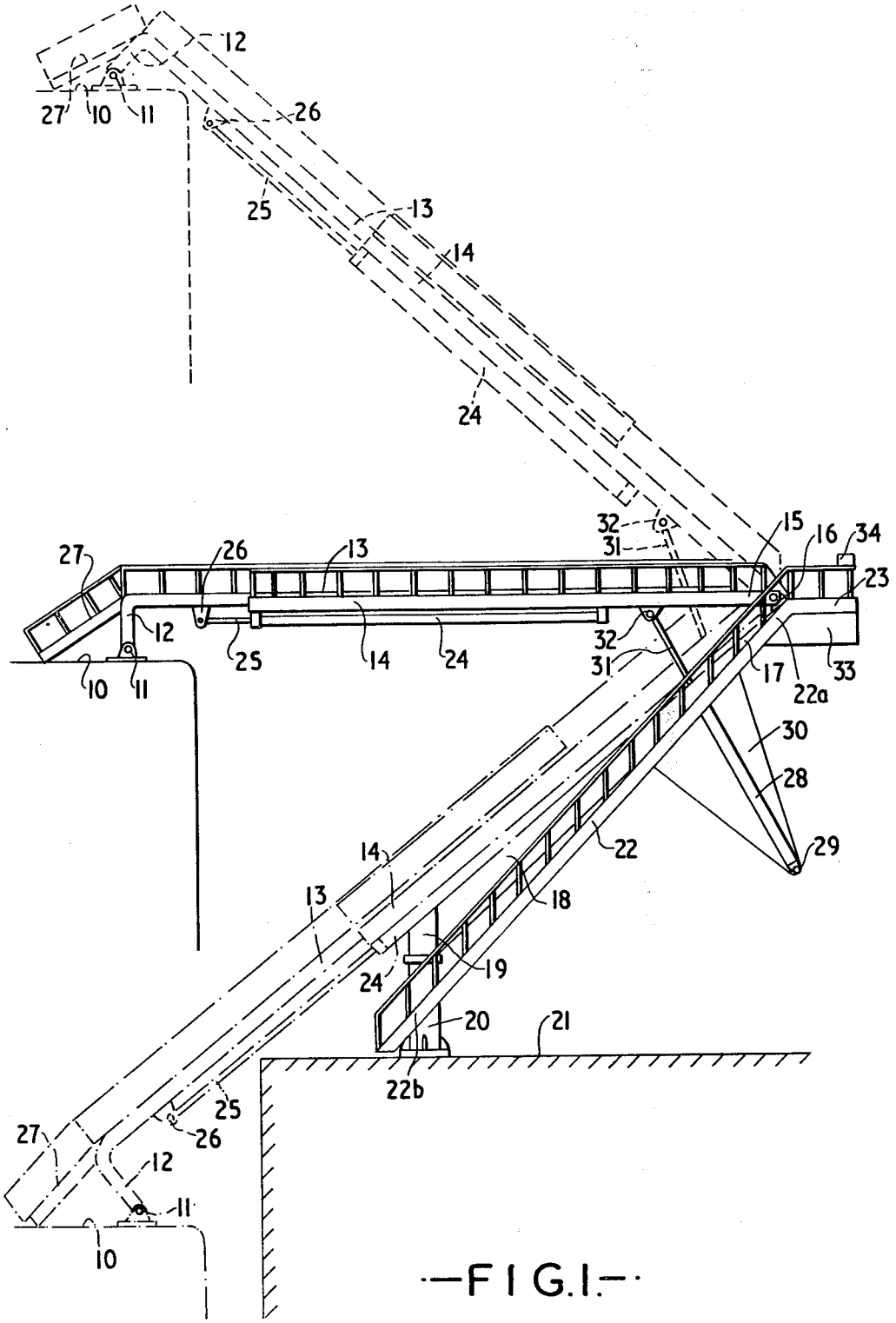

This invention relates to accommodation ladder arrangements of the kind having a length-regulatable first flight of steps one end of which is adapted to be connected to a ship and the other end of which is pivotably mounted about a horizontal axis at a certain level above the quayside, and a second flight of steps or a set of flights of steps connecting the first flight of steps to the quayside.

A similar construction is known in which said other end of the accommodation ladder is mounted about the horizontal axis at the top of a straight, upwardly inclined post. The known construction is slightly flexible in use so that one often gets an undesired steep path of the said first flight of steps. Besides, one is also dependent upon a relatively accurate positioning of the ship relative to the construction in order to be able to connect the latter in a favourable manner to the ship.

According to the present invention an accommodation ladder comprises a first flight of steps having an adjustable length with one end adapted for connection to a ship while its opposite end is pivotably mounted about a horizontal axis at a given level above the quayside, said flight of steps also being mounted for pivotal movement about a vertical axis passing between its opposite ends at a location substantially spaced from its horizontal pivotal axis, and a second flight of steps adapted for mounting at one end adjacent said quayside to pivot about said vertical axis and extending upwardly from its pivotal mounting to interconnect with said first flight of steps enabling joint pivoting with the latter about said vertical axis.

In the solution according to the invention, the accommodation ladder can be adjusted into various desired angular positions against the side of the ship so that one is less dependent upon the exact position of the ship relative to the gangway construction. In addition, with a definite fastening point on the quay there is achieved a possibility for arranging the horizontal pivotal axis of the first flight of steps at a greater distance from the side of the ship so that one can avoid thereby steep inclinations of the first flight of steps. The second flight of steps or the uppermost flight of steps of a series or set of flights of steps can extend in direct connection with the first flight of steps in order to provide a shortest possible connection with the flights of steps. This is made possible by swinging the second flight of steps or the series or set of flights of steps together with the first flight of steps about the vertical axis. The second flight of steps can thus extend in a straight line obliquely upwards from the vertical axis to the lower end of the first flight of steps or the series or set of flights of steps can extend correspondingly in a zig-zag path or in another suitable fashion from the vertical pivotal axis and upwards to the lower end of the first flight of steps.

In practice, it is preferred that the opposite end of the first flight of steps is supported in a fork-shaped support arm extending obliquely upwards and outwards from an upstanding support post mounted to pivot about the vertical axis and the second flight of steps is disposed outside the support arm with its upper end fastened to the arm and its opposite and lower end fastened to the support post, joint pivoting of the two flights of steps being effected by causing the support post to pivot about the vertical axis.

Figure 2:
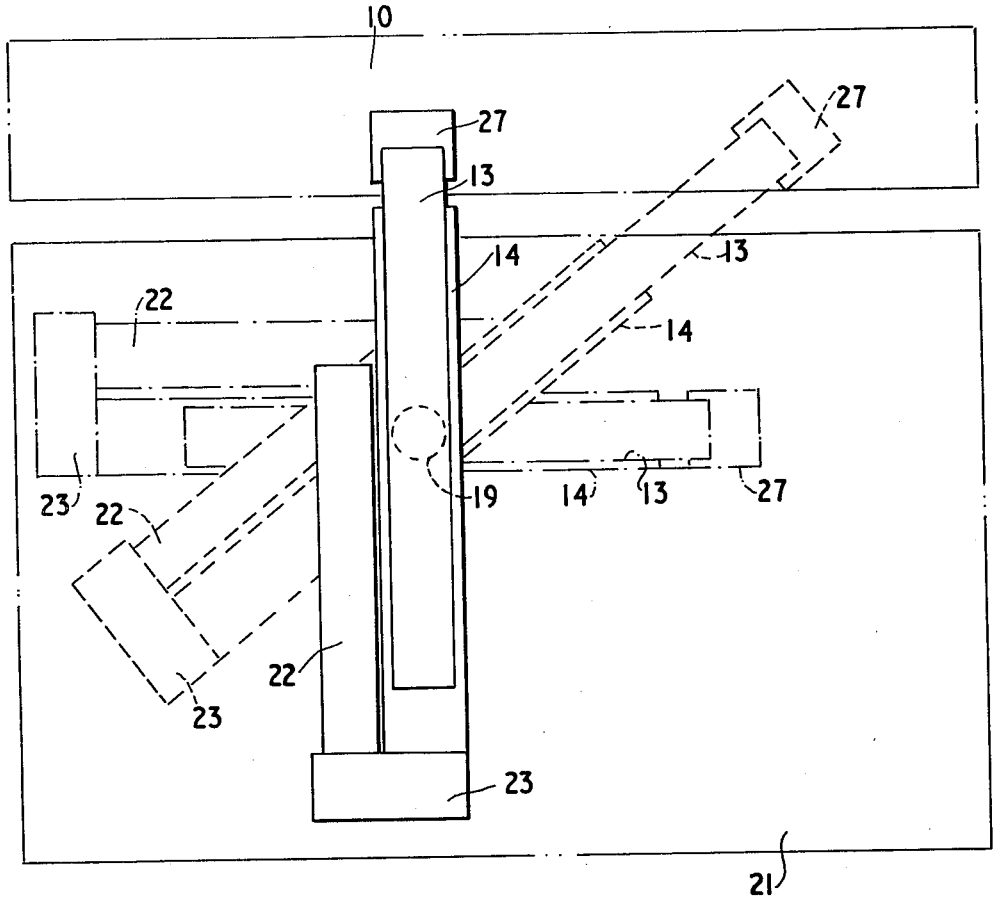

In order that the invention can be more clearly understood, a preferred embodiment thereof will now be described, by way of example, with reference to the accompanying drawings in which:

FIG. 1 is a sketch of the accommodation ladder according to the invention illustrated, in the vertical plane, in three different positions of use, and FIG. 2 is a schematic view of the accommodation ladder of FIG. 1 illustrated, in the horizontal plane, in three different positions of use.

Referring to the drawings, there is shown a deck portion 10 of a ship having a horizontal pivot bearing 11 for the one angled end 12 of a first flight of steps 13, 14. The pivot bearing 11 can itself be pivotable about a vertical axis. The other end 15 of the first flight of steps is pivotably mounted about a horizontal axis in a pivot bearing 16 fastened to the upper end 17 of a fork-shaped support arm 18 which projects obliquely upwards from a support post 19 which is pivotably mounted about a vertical axis in a socket 20 secured to the top of a quay 21. The first flight of steps 13, 14 is arranged within in forked engagement on the support arm 18, while a second flight of steps 22 is arranged on the outer side of the support arm 18. One end **22*a* of the second flight of steps is stationarily fastened to the support arm 18 and its other end 22*b* is stationarily fastened to the support post 19. End 22*a* is provided with a platform portion 23 which connects the flight of steps 22 to the flight of steps 13, 14**.

The first flight of steps 13, 14 consists of two longitudinally (telescopically) regulatable flight of steps portion 13 and 14, in which the one portion 13 is displaceable within the other portion 14 in a manner known per se. The displacement of the portions relative to each other is effected by means of a first pressure medium cylinder 24 which is fastened to the portion 14, while its piston rod 25 is jointed to a bracket 26 of the portion 13. At 27, there is shown an outer flight of steps portion which forms a connection between the flight of steps portion 13 and the deck of the ship and which can be swung about a horizontal axis at the outer end of the flight of steps portion 13.

The first flight of steps 13, 14 is swingable about the horizontal axis at the outer end of the support arm 18 by means of a pressure medium cylinder 28. The pressure medium cylinder 28 is, in turn, pivotably mounted about a joint location 29 in a bracket 30 on the support arm 18. The piston rod 31 is jointed to a bracket 32 of the portion 14.

In a box 33 on the under side of the platform part 23, there is arranged hydraulic equipment for the operation of the pressure medium cylinders 24 and 28. For the sake of clarity, the conduit connections from the hydraulic equipment to the respective pressure medium cylinders have been omitted. At 34, there is shown a control panel for actuating the hydraulic equipment for the respective pressure medium cylinders, and for a rotary motor (not shown) for rotating the support post 19 in the socket 20.

FIG. 1 shows how the first flight of steps can be adjusted into various inclined positions, as is indicated by the full lines, broken lines and chain lines respectively, at various levels on the respective ships' deck at different tide levels or deviations produced by loading and unloading. After the first flight of steps is arranged in position on the ship's deck in jointed connection with the latter and after the pressure medium actuation of the said pressure medium cylinders 24, 28 is broken off, the first flight of steps can be freely swung between the illustrated positions in step with the vertical movements of the ship relative to the quay.

FIG. 2 shows how the first flight of steps can be adjusted into various use positions considered in a horizontal plane, as is indicated by the full and broken lines respectively. In addition, the accommodation ladder can be swung to a parked inactive position parallel to the side of the ship as is indicated by the chain lines. In the last-mentioned position, the first flight of steps can be allowed to rest with the outer end 12 and the flight of steps portion 27 against the top of the quay.

The second flight of steps 22 is shown with a rectilinear path, but in practice can also be designed in another manner, for example with a zig-zag path.

What we claim is:

1. Accommodation ladder arrangement comprising:

(a) a first flight of steps the length of which is regulatable and having one end adapted for connection to a ship while its opposite end is pivotably mounted about a horizontal axis at a given level above the quayside, said flight of steps also being mounted for pivotal movement about a vertical axis passing between its opposite ends at a location substantially spaced from its horizontal pivotal axis, (b) means for swinging said first flight of steps about said horizontal pivotal axis, (c) a second flight of steps adapted for mounting at one end adjacent said quayside to pivot about said vertical axis and extending upwardly from its pivotal mounting to interconnect with said first flight of steps enabling joint pivoting with the latter about said vertical axis, (d) means for adjusting the length of said first flight of steps, and (e) means for jointly swinging said first and second flights of steps about said vertical axis.

2. The arrangement of claim 1, wherein said opposite end of said first flight of steps is supported in a fork-shaped support arm extending obliquely upwards and outwards from an upstanding support post mounted to pivot about said vertical axis and said second flight of steps is disposed outside said support arm with its upper end fastened to said arm and its opposite and lower end fastened to said support post, and said means for jointly swinging said flights of steps serving to effect said swinging movement by pivoting said support post about said vertical axis.

3. The arrangement of claim 1 or 2, wherein said second flight of steps is made up of more than one flight.

* * * * *